United States Patent [19]

Ricketts

[11] 4,443,036

[45] Apr. 17, 1984

[54] EXPLOSIVE EXPANSION OF FORMATION IN LIFTS FOR FORMING AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 281,566

[22] Filed: Jul. 9, 1981

[51] Int. Cl.[3] ..... E21B 43/24

[52] U.S. Cl. ..... 299/2; 299/13

[58] Field of Search ..... 299/2, 13; 166/259

[56] References Cited

U.S. PATENT DOCUMENTS

| | | | |
|---|---|---|---|
| 3,434,757 | 3/1969 | Prats | 299/13 |
| 3,466,094 | 9/1969 | Haworth et al. | 299/13 |
| 3,661,423 | 5/1972 | Garrett | 299/2 |
| 4,043,595 | 8/1977 | French | 299/13 |
| 4,146,272 | 3/1979 | French | 299/2 |

OTHER PUBLICATIONS

Winzer, et al., "High-Speed Cinematography of Blasting Operations", Aug. 1979, Martin Marietta Laboratories, MML TR-79-36.

Winzer et al., "The Science of Blasting", Nov. 1978, Martin Marietta Laboratories.

*Primary Examiner*—William F. Pate, III

*Attorney, Agent, or Firm*—Christie, Parker & Hale

[57] ABSTRACT

An in situ oil shale retort is formed by excavating a lower level void adjacent the bottom boundary of a retort site in a subterranean formation, leaving a zone of unfragmented formation within side boundaries of the retort overlying the void. At least a portion of the overlying zone is explosively expanded downwardly towards the void in a plurality of lifts. Vertical columnar explosive charges are placed in each lift and detonated in a single round with a time delay between successive lifts sufficient for formation of the first lift to move out of the way and not interfere with initial explosive expansion of formation in the next successive lift. Preferably, the explosive charges in a second lift are detonated after detonation of explosive charges in a first lift with a time delay in the range of from about five to thirty milliseconds per foot of burden distance of the charges in the second lift. When plural lifts above the first lift are explosively expanded, it is preferred that the time delays progressively increase from the bottom up.

25 Claims, 4 Drawing Figures

EXPLOSIVE EXPANSION OF FORMATION IN LIFTS FOR FORMING AN IN SITU OIL SHALE RETORT

FIELD OF THE INVENTION

This invention relates to formation of an in situ oil shale retort by explosively expanding overlying zones of formation towards an underlying void and more particularly timing of detonation of explosive charges in successive lifts of the overlying zone.

BACKGROUND OF THE INVENTION

The presence of large deposits of oil shale in the semiarid high plateau region of the United States has given rise to extensive efforts to develop methods for recovering shale oil from kerogen in the oil shale deposits. It should be noted that the term "oil shale" as used in the industry is, in fact, a misnomer, it is neither shale nor does it contain oil, it is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598 and 4,192,554 as well as pending patent application Ser. No. 246,232 filed Mar. 23, 1981, by Chang Yul Cha, entitled TWO LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone oxygen from the retort inlet mixture is depleted by reaction with hot carbonaceious materials to produce heat, combustion gas and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products together with water produced in or added to the retort collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition and any gaseous retort inlet mixture that does not take part in the combustion process.

U.S. Pat. Nos. 4,043,597; 4,043,598; and 4,192,554, disclose methods for explosively expanding formation containing oil shale toward horizontal free faces to form a fragmented mass in an in situ oil shale retort. According to such a method a plurality of vertically spaced apart voids of similar horizontal cross section is initially excavated one above another within the retort site. A plurality of vertically spaced apart zones of unfragmented formation is temporarily left between the voids. Explosive is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. Pat. application Ser. No. 246,232 discloses a method for explosively expanding formation containing oil shale towards a horizontal free face to form a fragmented mass in an in situ oil shale retort. According to such a method, a void having a horizontal cross section similar to the horizontal cross section of the retort being formed is initially excavated. A plurality of vertically spaced apart zones or lifts of unfragmented formation is left above the void. Explosive is placed in each of the unfragmented lifts and detonated for explosively expanding such zones towards the void to form a fragmented mass in the retort having an average void volume about equal to the void volume of the initial void. The overlying lifts can be expanded towards the void in a single round or a plurality of rounds. Retorting of the fragmented mass is then carried out to recover shale oil from the oil shale.

As used herein the term "lift" means a generally horizontally extending layer of the subterranean formation that is explosively expanded in a single round with no more than a short delay interval between explosive charges used for explosively expanding such a lift. In this context a lift can be explosively expanded either upwardly or downwardly. A delay interval is considered short when adjacent explosive charges interact to provide greater explosive expansion than can be provided by explosive charges that do not interact. An exemplary short time delay is about one to two milliseconds per foot of spacing distance between adjacent explosive charges. When forming an in situ oil shale retort by explosively expanding two or more overlying zones or lifts into an underlying void in a single round, it has been suggested that it is desirable to detonate explosive charges in successive lifts with as small a time delay as possible between successive lifts. A typical suggestion is that the time delay between successive lifts should be on the order of about one millisecond of delay per foot of burden of the later lift being explosively expanded. This technique may not result in optimum fragmentation and expansion of the formation when explosively expanding formation towards a limited void. Even if expansion of a subsequent lift could keep a preceding lift from overexpanding, optimum distribution of void fraction in the resultant fragmented mass may not be obtained. The subsequent lift or lifts may not have adequate room to fragment and expand, leaving regions with low permeability in the fragmented mass.

It is desirable to provide a technique for explosive expansion of successive lifts towards an underlying limited void which assures adequate fragmentation to avoid an excessive amount of large particles of formation that may not be completely retorted and to assure reasonably uniform void fraction distribution in the fragmented mass formed by explosive expansion. This helps avoid regions of excessively low permeability which would interfere with uniform gas flow or prevent retorting of portions of the fragmented mass. It is also desirable to minimize the quantity of explosive required for explosive expansion and minimize overbreak in adjacent unfragmented formation.

SUMMARY OF THE INVENTION

There is, therefore, provided in practice of this invention according to presently preferred embodiments a method for forming an in situ oil shale retort in a subterranean formation containing oil shale, such a retort containing a fragmented permeable mass of formation particles. At least one horizontally extending void is excavated within the retort site, leaving an overlying zone of unfragmented formation above such a void. The overlying zone of formation is explosively expanded toward the underlying void in a plurality of lifts by detonating a plurality of explosive charges in successive lifts in a single round. The explosive charges in a second lift above the first lift are detonated with a sufficient time delay that formation in the first lift does not interfere with initial explosive expansion of the second lift. Preferably, the time delay between the first and second lifts is in the range of from about five to thirty milliseconds per foot of burden. When there are plural lifts above the first lift, it is preferable that the time delays between successive lifts progressively increase.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
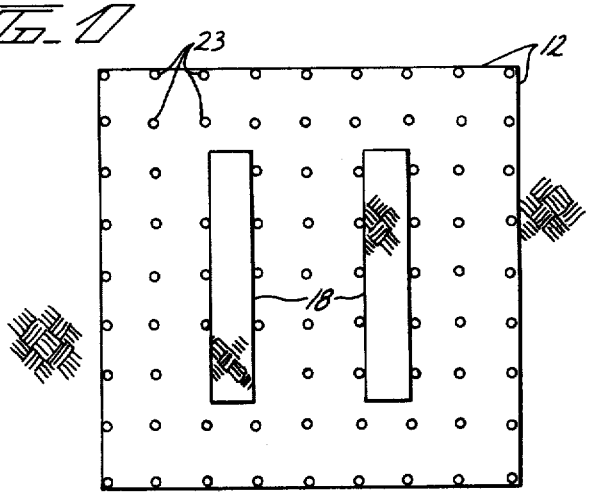
FIG. 1 is a semi-schematic horizontal cross-sectional view through an upper portion of an in situ oil shale retort site at an intermediate stage during formation of the retort.
Figure 2:
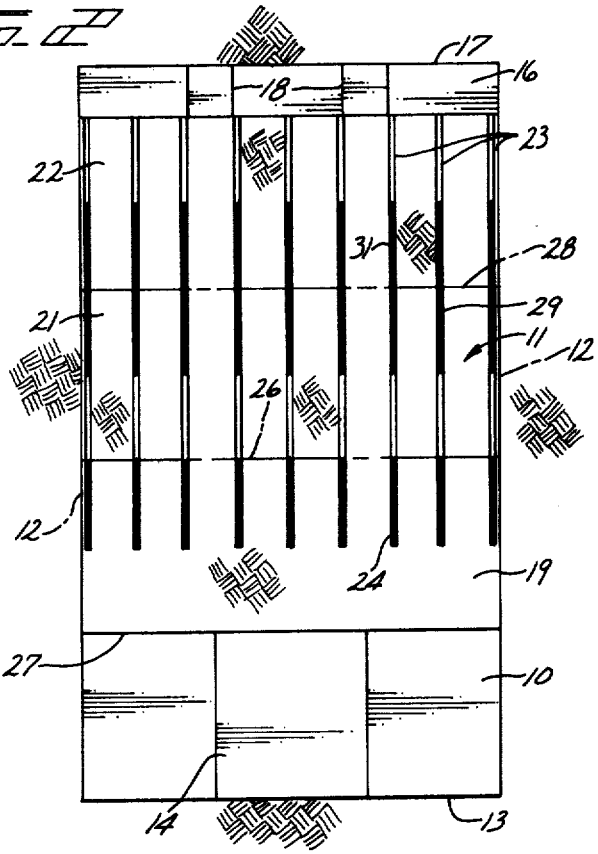
FIG. 2 is a semi-schematic vertical cross-section through the retort of FIG. 1.

FIGS. 1 and 2 are semi-schematic views in horizontal and vertical cross section respectively of an in situ oil shale retort site at an intermediate stage during formation of an in situ oil shale retort. As illustrated in this embodiment, a generally horizontally extending void 10 is excavated in a subterranean formation containing oil shale, leaving a zone 11 of unfragmented formation above the void within the side boundaries 12 of the in situ oil shale retort being formed. The lower level void 10 is excavated adjacent the bottom boundary 13 of the retort. If desired, a lower level pillar 14 of unfragmented formation can be left in the lower level void for temporarily supporting overlying formation.

In the illustrated embodiment an upper level void 16 is excavated adjacent the top boundary 17 of the retort site. A pair of upper level pillars 18 of unfragmented formation are left in the upper level void for temporarily supporting formation above the void. The upper level void 16 is generally vertical above the lower level void 10 leaving the zone 11 of unfragmented formation in between the excavated voids.

To form a fragmented mass of formation particles in the in situ oil shale retort, the pillars 14 and 18 and the intervening zone 11 of formation are explosively expanded toward the voids 10 and 16. This invention concerns the timing between explosive charges for such expansion.

In the embodiment illustrated in FIGS. 1 and 2 the pillars and zone of formation intervening between the voids are explosively expanded in sequence in a single round of explosions. Explosive expansion in a single round as used herein means detonation of a number of separate explosive charges either simultaneously or with only a short time delay between separate detonations. A time delay between explosions in a sequence is short when formation explosively expanded by detonation of one explosive charge has either not yet moved or is still in motion at the time of detonation of a subsequent explosive charge.

The sequence of explosive expansions in the embodiment illustrated in FIGS. 1 and 2 proceeds as follows. Explosive charges (not shown) are detonated in the lower level pillar 14 for explosively expanding the pillar and distributing the fragments across the lower level void 10. Thereafter, a first lift 19 of the zone of unfragmented formation immediately above the lower level void is explosively expanded towards the lower level void. The pillars 18 in the upper level void are explosively expanded for distributing the fragments across the upper level void. The pillars in the upper level void can be explosively expanded more or less at the same time as the first lift 19 or thereafter. Finally, a second lift 21 above the first lift and a third lift 22 above the second lift are explosively expanded downwardly towards the lower level void and upwardly towards the upper level void respectively. In this embodiment the second and third lifts are expanded simultaneously. The time delay between explosive expansion of the first lift 19 and second lift 21 is preferably in the range of from about five to 30 milliseconds per foot of burden in the second lift in accordance with principles of this invention. Such a time interval is sufficiently long that formation in the first lift does not interfere with initial explosive expansion of formation in the second lift. As used herein "burden" or "burden distance" is the distance from the center of mass of explosive charges to the free face towards which formation is expanded upon detonation of such charges.

To obtain expansion of the formation in the intervening zone of unfragmented formation, a plurality of blast holes 23 are drilled downwardly from the upper level void into the intervening zone. A plurality of generally vertically extending columnar explosive charges 24 are placed in bottom portions of blast holes in the first lift 19. This forms a horizontally extending array of explosive charges in the upper half of the first lift; that is, the centroids of the vertical charges lie in a generally horizontal plane about three-fourths of the thickness of the lift above the free face 27 at the bottom of the first lift, i.e., the roof of the lower level void 10. Each explosive charge extends from the upper boundary 26 of the first lift halfway towards the free face 27. For example, the vertical height of the first lift can be 68 feet and the bottom end of each columnar explosive charge is about 34 feet from the horizontally extending free face. Each explosive charge is about 34 feet long. The burden distance for the explosive charges 24 is the distance from the center of mass of an explosive charge to the free face 27. Thus, in the exemplary embodiment, the burden distance for the horizontally extending array of explosive charges is 51 feet.

The total explosive in the horizontally extending array of explosive charges 24 is sufficient for explosively expanding the formation in the first lift from the horizontally extending free face 27 to the upper boundary 26 of the first lift indicated by a horizontal phantom line in FIG. 2.

The explosive charges in the array can be detonated simultaneously for explosively expanding the first lift or preferably can be detonated with short delay intervals within the array so that groups of such explosive charges are detonated substantially simultaneously with short delay intervals between adjacent groups. In an exemplary embodiment, the spacing distance between explosive charges in the array is about 20 feet. The delay interval between detonation of adjacent groups of explosive charges within the array can be in the order of about one to two milliseconds per foot of spacing distance. Thus, in the exemplary embodiment a delay interval of about 25 milliseconds between adjacent groups is appropriate.

A variety of patterns of detonation sequences within the array can be used. For example, the first detonation can be in a group of explosive charges near the center of the array and subsequent groups can be in bands surrounding the first group and progressing radially away from the center of the array toward the side boundaries of the retort. Many other arrays and patterns of detonation sequence are also suitable for practice of this invention.

Inert stemming such as sand or gravel is placed in the blast holes 23 above the explosive charges 24 in the horizontally extending array in the first lift 19. Above the inert stemming additional explosive is loaded into the blast holes and the uppermost portion of each of the blast holes above this explosive is filled with stemming. This upper group of generally vertically extending columnar loads of explosive forms, in effect, two horizontally extending arrays of explosive charges. The remaining portion of the zone of unfragmented formation above the upper boundary 26 of the first or lower lift 19 can be considered to be divided in half as indicated by a phantom line 28 in FIG. 2, into a second lift 21 above the first lift and a third lift 22 above the second lift.

The upper columns of explosive in the blast holes form a horizontally extending array of explosive charges 29 in the upper half of the second lift 21 and another horizontally extending array of columnar explosive charges 31 in the bottom half of the third lift 22. The explosive charges 29 and 31 in the second and third lifts are continuous in the blast holes extending through the second and third lifts. Preferably detonators are provided at the mid plane 28 between the second and third lifts so that the explosive charges symmetrically explosively expand the second and third lifts respectively. Thus, although the columns of explosive are continuous between the two lifts, the charges behave as if they were completely separate insofar as explosive expansion of the two lifts is concerned. The explosive charges 29 in the upper half of the second lift 21 expand the second lift downwardly toward the underlying void. The explosive charges 31 in the lower half of the third lift 22 explosively expand the third lift upwardly toward the overlying void 16. The second and third lifts are explosively expanded simultaneously as the explosive charges 29 and 31 are simultaneously detonated.

The explosive charges in the upper two lifts can be detonated simultaneously or with short delay intervals between groups of such explosive charges as described above with respect to the explosive charges in the first lift. The pattern of delay intervals in the second and third lifts can be the same as the pattern in the first lift or can be different.

The volume of the lower void 10 relative to the volume of formation explosively expanded towards that void is less than an unlimited void. That is, the void has less available volume than would be required for free, unconfined expansion of formation towards the void.

When an earth formation is explosively fragmented and expanded, it increases in bulk due to the void space in interstices between the particles. The maximum expansion of an oil shale formation into an unlimited void results in a fragmented mass having an average void fraction somewhat above about 38%; that is, about 38% of the total volume occupied by the fragmented mass is void space between the particles. The volume occupied by the fragmented mass is about 61% larger than the volume occupied by the original unfragmented formation after such unlimited or free expansion. This is sometimes referred to as a bulking factor of 1.61.

A "limited void" is one where the void space available for explosive expansion is less than needed for free bulking of the formation expanded towards that void. Thus, if a void has an excavated volume less than about 38% of the total of the volume of the void plus the volume occupied by formation which is to be explosively expanded into that void, it is necessarily a limited void. It has been found that factors other than total available void can make a void "limited" even though the total available void may be sufficiently large for free bulking. Thus, the fragmented mass formed by explosive expansion may not expand to completely fill available void space and the average void fraction in the fragmentd mass may be less than projected from the available void space or free bulking estimates.

Figure 3:
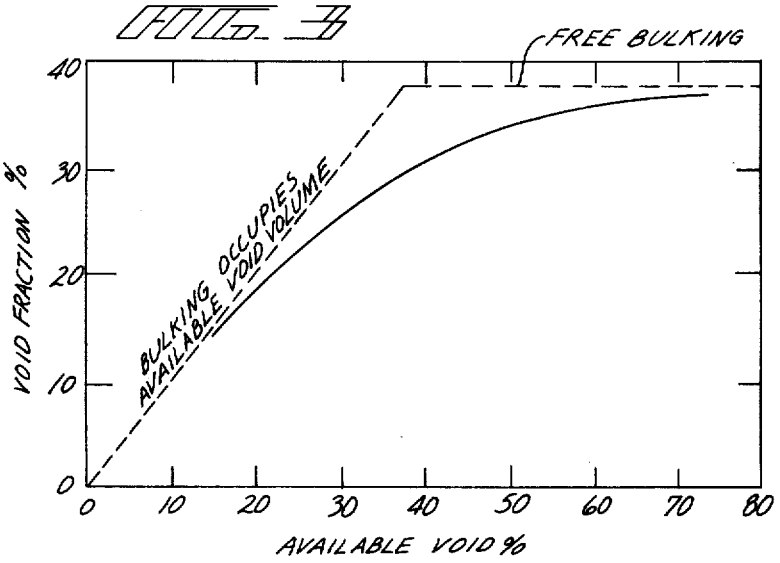
FIG. 3 is a graph of void fraction in a fragmented mass as a function of available void.

FIG. 3 is a graph of void fraction (in percent) in a fragmented mass as a function of the available void, also stated as a percentage. The available void is the percentage of the volume of an excavated void relative to the total volume of the excavated void plus the volume occupied by formation to be expanded towards that void. The available void can also refer to the void space remaining after explosive expansion of formation toward an excavated void.

One would expect the void fraction in a fragmented mass to equal the available void up to a void fraction corresponding to free bulking. Once the free bulking void fraction is reached there should be no increase in void fraction with increasing available void. Thus, if the available void were 28% for example, one would expect the void fraction in the fragmented mass to be 28%. If the available void were 40%, the void fraction would be expected to be about 38%. This expectation is indicated by the dashed line in FIG. 3 which increases with a slope of one up to about 38% and above a void fraction of about 38% there is no increase regardless of increasing available void.

It has been found, however, that the actual void fraction in a fragmented mass is less than the available void up to available voids substantially above 38%. Thus, for example with an available void of about 28%, in one test the average void fraction in a fragmented mass was only about 23%. Similarly, in one test with an available void of about 55%, the fragmented mass void fraction was only about 35%. Such an experimentally determined relation is illustrated by the solid line in FIG. 3.

It is now known that an excavated void can behave as a limited void even though the available void volume is larger than required for free bulking because of interaction of particles during explosive expansion with boundaries of unfragmented formation. Thus, for example, formation expanding from the first lift 19 can interact with the side walls of the void 10 or the opposite wall of unfragmented formation at the bottom boundary 13 to inhibit free expansion, thereby limiting the actual void fraction obtained in the resulting fragmented mass. The same effect can occur when expanding formation from the second lift 21 collides with formation expanding from the first lift 19.

It is important when explosively expanding formation toward such a limited void to obtain as much bulking as feasible and minimize nonuniformity of void fraction in various regions of the fragmented mass. This tends to minimize pressure drop as gas flows through the fragmented mass and minimizes gas flow maldistribution. The timing of detonation of explosive charges for explosive expansion of successive lifts can assist in this regard.

Deviation from the expected free bulking line (void fraction equals available void percentage) has its principal significance when the void fraction desired in the fragmented mass is less than about 35%, that is, when the volume of the available void is about 55% of the sum of available void volume plus volume of formation expanded towards that void. The effect of void fraction maldistribution is more significant for lower void fractions than for higher void fractions. When the available void is more than about 55%, constraints on time delays as described herein can be relaxed since adverse effects can be acceptable in commercial practice. The effect of explosive expansion toward a limited void is still considered for projecting the volume of the resultant fragmented mass so that the available volume of the void space remaining over the fragmented mass can be estimated.

When determining the available void volume for explosive expansion of a lift toward a void containing a pillar, the volume of the pillar fragments should be considered. It is desirable to explosively expand such a pillar before the adjacent lift is expanded. The pillar "sees" an available void that can be a limited void or an unlimited void. After explosive expansion the pillar fragments occupy some of the original excavated void volume with a bulking that depends on the available void volume for expansion of the pillar. The available void for explosive expansion of the adjacent lift is the volume of void remaining after subtracting the volume occupied by the pillar fragments. The available void volume is about the same whether the pillar fragments have come to rest or are still in flight when the explosive charges in the adjacent lift are detonated.

Preferably, the time delay between detonation of explosive charges in the second lift after detonation of explosive charges in the first lift is in the range of from about five to 30 milliseconds per foot of burden distance for the explosive charges in the second lift. The burden distance for charges in the second lift is distance from the center of mass of such explosive charges to the free face where explosive expansion of the second lift commences. The free face for the second lift is the generally horizontal plane 26 at the upper boundary of the first lift. When the first lift is explosively expanded a new free face is formed along a generally horizontal plane at about the upper ends of the columnar explosive charges in the first lift. The newly formed free face is indicated by the phantom line 26 in FIG. 2. Detonation of explosive charges in the second lift explosively expands the second lift towards the newly formed free face. The burden distance of such charges is from the centroids of such charges to the newly formed free face at the top of the first lift.

In an exemplary embodiment, the second lift has a vertical thickness of about 68 feet and the explosive charges 29 have an effective length of about 34 feet. Thus, the burden distance from the centers of the explosive charges to the newly formed free face 26 is about 51 feet. In such an embodiment the time delay between detonation of explosive charges in the first lift and detonation of explosive charges in the second lift would be in the range of from about one-quarter to one and one-half seconds.

As mentioned above, the explosive charges in each lift can be detonated simultaneously or can be detonated in groups with short delay intervals between groups within a lift. Such delay intervals are in the order of one to two milliseconds per foot of spacing distance. The time delay of five to 30 milliseconds per foot of burden between detonation of explosive charges in adjacent lifts generally refers to the time delay between the last charge or charges detonated in the first lift and the first charge or charges detonated in the second lift. This criterion can be eased somewhat when charges within a lift are detonated in groups, for example, in bands radiating from a central portion of each lift. The minimum time delay between lifts can be considered as being between explosive charges in successive lifts that are in blast holes at least two spacing distances apart.

This criterion can be better understood by reference to an example described solely for purposes of illustration. In this example explosive charges in each lift are detonated in rows. Thus, in the first lift the first row of charges is detonated simultaneously followed successively by the second, third, fourth, etc. rows with a short delay interval between successive rows. Similarly, in the second lift the sequence is of the first, second, third, etc. rows with a short delay interval between successive rows According to the eased criterion the time delay between successive lifts refers to the time delay between detonation of charges in the first row of the second lift and at least the third row in the first lift, which is two spacing distances from the first row. Similar principles can be applied for other useful patterns of delay intervals wihin each lift.

A minimum time delay between detonation of explosive charges in the first lift and detonation of explosive charges in the second lift of at least about five milliseconds per foot of burden is employed to assure that there is sufficient time for formation in the first lift to move out of the way and avoid interference with initial expansion of formation in the second lift. It is believed that as formation expands upon detonation of columnar explosive charges perpendicular to the free face, there is a gradient of acceleration and velocity between the free face and the portion of the formation remote from the free face. Formation near the free face moves sooner and faster than formation remote from the free face.

Since a large volume of formation must be accelerated by the explosion, there is an appreciable time delay between detonation of the explosive charges and movement of the formation at the deepest portion of the lift being explosively expanded. Thus, a certain time is required for formation of a new free face at the generally horizontal plane 26 at the upper boundary of the first lift in the embodiment illustrated in FIGS. 1 and 2. It has previously been thought that the time delay between adjacent lifts need be only sufficient for formation of the new free face. A time delay of one to two milliseconds per foot of burden or less was considered adequate.

When such a short time delay between adjacent lifts is used when explosively expanding formation towards a limited void, it is found that expansion of formation in the second lift is apparently inhibited and the expected fragmentation and void fraction in the portion of the fragmented mass formed by the second lift is not obtained. This can lead to unexpectedly poor void fraction distribution in the fragmented mass in an in situ oil shale retort. Maldistribution of void fraction in the fragmented mass in a retort can interfere with complete and economical retorting. It is believed that formation near the free face for the second lift may be catching up with moving formation from deep in the first lift due to velocity differences. The interaction of the initially expanded formation from the second lift with the moving formation of the first lift can further inhibit expansion of the second lift and result in abnormally low void fraction and poor fragmentation in formation expanded in the second lift due to inadequate relief.

By using a time delay of at least five milliseconds per foot of burden between adjacent lifts, the expanding formation from the first lift has sufficient time to move away from the newly created free face a sufficient distance that formation from initial expansion of the second lift does not catch up with the first lift in time to interfere significantly with full expansion of the second lift. This promotes uniform distribution of void fraction in the fragmented mass.

If the formation from the first lift has not moved out of the way of formation from the second lift, some of the explosive energy in the explosive charges in the second lift can be directed upwardly and outwardly into surrounding unfragmented formation rather than being effectively used to expand the second lift. In an embodiment as illustrated in FIGS. 1 and 2 where the second lift expands downwardly and the third lift expands upwardly, an assymetry in explosive expansion of the second and third lifts can result. In an embodiment as hereinafter described where the third lift is also expanded downwardly after an additional time delay, explosive energy from the second lift directed upwardly and outwardly is essentially wasted. Energy directed upwardly and outwardly can also increase overbreakage in unfragmented formation.

The maximum time delay between successive lifts is preferably less than about 30 milliseconds per foot of burden. If the delay is much longer than about 30 milliseconds per foot, the possibility of collapse of formation from above the newly formed free face is significantly increased. Such collapse of formation can severely affect the void fraction distribution in a fragmented mass. Such collapse is likely to occur in large flat slabs which may not break up and can cause severe obstructions to gas flow through the fragmented mass. Further, if a substantial collapse of formation above the new free face occurs, the new burden distance for the explosive charges in the second lift is significantly reduced and expansion can be overly energetic. Time is required for such collapse to occur and time delays of as much as 30 milliseconds per foot of burden can be safely used without significant hazard of collapse of formation above the newly created free face.

In an exemplary embodiment of an in situ oil shale retort as illustrated in FIGS. 1 and 2, the lower level void can be about 65 feet high and about 165 feet square. The pillar of unfragmented formation remaining in the lower level void occupies about 20 percent of the horizontal cross-sectional area of the void. A representative upper level void is about 20 feet high and the pillars left in the void occupy about 13 percent of its horizontal cross-sectional area. Each of the three lifts between the upper and lower level voids is about 68 feet thick. These lifts are considered to be about 162 feet square; that is, slightly smaller than the upper and lower level voids since some clearance is needed adjacent the walls of the voids for drilling equipment for drilling the blastholes in which explosive charges are placed. When the pillars and zone of formation between the upper and lower level voids is explosively expanded, the resultant fragmented mass has an average void fraction of about 24.5 percent if the retort is filled to the top boundary or somewhat less when there is a void space between the top of the fragmented mass and the top boundary of unfragmented formation.

Figure 4:
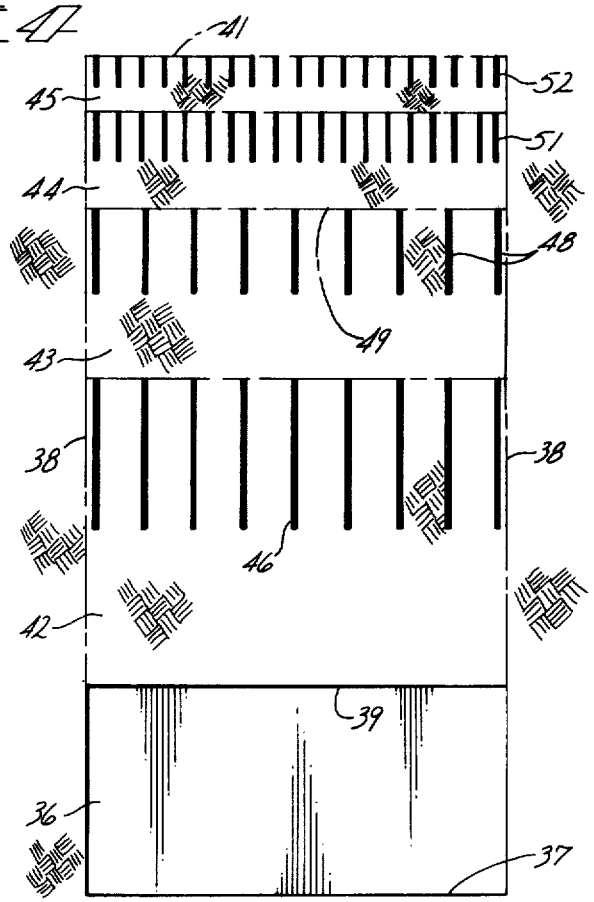
FIG. 4 is a semi-schematic vertical cross-section illustrating another arrangement for forming in an situ oil shale retort.

FIG. 4 illustrates in semi-schematic vertical cross-section another embodiment of technique for explosively expanding formation for forming an in situ oil shale retort. In this embodiment, a lower level void 36 is excavated adjacent the bottom boundary 37 of the in situ oil shale retort being formed. The void extends to the side boundaries 38 of the retort site and, if desired, can contain a pillar (not shown) of unfragmented formation for temporarily supporting overlying formation. Between the free face 39 at the roof of the void and the top boundary 41 of the retort being formed is a zone of unfragmented formation which is to be explosively expanded towards the void. This zone is explosively expanded downwardly in four lifts 42, 43, 44, and 45, commencing with the lowermost lift 42. The underlying void is a limited void with respect to the volume of formation explosively expanded towards that void.

A plurality of columnar explosive charges 46 are placed in a horizontally extending array in the upper half of the first lift 42 for explosively expanding the first lift downwardly towards the underlying void. The explosive charges are placed in vertical blastholes drilled from the ground surface or from overlying underground workings. The blastholes between and above the explosive charges are deleted from this drawing for clarity. Detonation of the explosive charges expands the formation in the first lift and creates a new free face at a generally horizontal plane 47 between the first and second lifts.

Another horizontally extending array of generally vertical columnar explosive charges 48 is placed in the upper half of the second lift 43 for explosively expanding that lift in a similar manner. Detonation of those explosive charges 48 expands the second lift and creates another new free face 49 between the second and third lifts. Similarly, a third horizontally extending array of columnar explosive charges 51 is provided in the upper half of the third lift 44 and a horizontally extending array of explosive charges 52 is placed in the uppermost lift 45 for explosively expanding these two lifts, respectively. The explosive charges in each blasthole are separated by inert stemming, not shown.

In the illustrated embodiment, each successive lift above the first lift 42 is thinner or less voluminous than the lift immediately below it. Thus, the second lift 43 is thinner than the first lift 42, the third lift 44 has less volume of formation than the second lift, and the fourth lift 45 is still less voluminous. When the first lift is explosively expanded toward the underlying limited void 36, the void fraction in the resulting portion of the fragmented mass is determined by the available void volume. For example, if the volume of the excavated void is about 30% relative to the volume of formation in the first lift plus the volume of the void, the resulting portion of the fragmented mass has a void fraction less than 25%, as indicated by the graph in FIG. 3. The fragmented mass occupies more volume than the formation before expanding by a "bulking factor", BF, where $BF=1/(1-VF)$, where VF is void fraction. The volume of the fragmented mass is less than sufficient to fill the volume originally occupied by the void 36 and first lift 42, hence a void space remains between the top of the fragmented mass and the bottom of the second lift.

When the second lift is explosively expanded toward the void space, it is desirable that the void fraction in this next portion of the fragmented mass be about the same as the void fraction in the first portion. The ratio of the volume of the second lift relative to the void space should, therefore, be the same as the ratio of the volume of the first lift relative to the volume of the excavated void. When such a ratio is used for each successive lift, the void fraction in the fragmented mass is reasonably uniform. A small void space can remain between the top boundary of the retort and the top of the fragmented mass from expanding the uppermost lift.

When the available void is a limited void, the relation between void fraction and available void indicated in FIG. 3 appears independent of the time interval between explosively expanding successive lifts. Thus, similar void fractions are obtained whether the lifts are expanded with hours or days between lifts or whether all the lifts are expanded in a single round. In the latter technique, the void space between successive lifts may not be observable since, in effect, it is filled with formation from a successive lift about as fast as it is formed by movement of formation from the preceding lift. If the time delay between successive lifts is too short, the "void space" effect could be partly nullified and expanding formation in the second lift could behave as if the void space were too small, giving a low void fraction in the portion of the mass formed from the second lift. By having sufficient time delays between lifts, as described herein, the second lift can behave just as if the void space were fully formed and reasonably uniform void fraction can be obtained.

The explosive charges in all of the lifts are detonated sequentially in a single round for explosively expanding the overlying zone of formation downwardly towards the underlying void. Detonation of explosive charges within each lift can be simultaneous or in groups as hereinabove described. Time delays are provided between detonation of explosive charges in successive lifts for minimizing void fraction maldistribution.

In an embodiment in which plural lifts above the first lift are explosively expanded downwardly toward an underlying void, the minimum time delays between successive lifts are progressively increased from the bottom up to provide adequate time for formation in each lift to move out of the way of initial explosive expansion of each succeeding lift.

The time delay between detonation of explosive charges in the first and second lifts is preferably in the range of from about five to 30 milliseconds per foot of burden and, more preferably, in the range of from about five to 15 milliseconds per foot. The time delay between the second and third lifts is at least about 10 milliseconds per foot of burden and less than about 30 milliseconds per foot of burden. Still more preferably, the time delay between the second and third lifts is in the range of from about 10 to 20 milliseconds per foot of burden. The time delay between the third and fourth lift is at least about 15 milliseconds per foot of burden and preferably is in the range of from about 15 to 30 milliseconds per foot of burden.

In an embodiment with more than two lifts explosively expanded towards an underlying void, it is particularly preferred that the time delay between the first and second lifts is less than about 15 milliseconds per foot of burden. The total time from detonation of the first charges in the first lift to the last charges in a third or fourth lift can become excessively long when the time delay between the first and second lifts is more than about 15 milliseconds per foot of burden. A long time delay for the entire explosive detonation sequence can be more difficult to implement since the precision of commercially available time delay detonators for explosive charges is somewhat poorer for long time delays than for short time delays. Greater care must, therefore, be taken to assure that detonations occur in the proper sequence.

Detonators for explosive charges can be either electrical or non-electrical. In the non-electrical variety, the time interval is determined by a burning "powder train" and long time intervals are somewhat difficult to control with precision. Electrically initiated detonators can also include a burning powder train for a time delay following initiation or, if desired, time sequencing can be centrally controlled by sending a sequence of electrical signals to successive electrical detonators. With this latter arrangement, the timing sequence can be controlled more readily and the maximum time delay between the first and second lifts can be somewhat relaxed without sacrificing precision. The use of successive electrical signals may not be suitable if the wires need to extend through a void containing a pillar since explosive expansion of the pillar could prematurely sever such wires.

The maximum time delay between the second and third lifts is preferably about 20 milliseconds per foot of burden for reasons similar to the maximum of 15 milliseconds per foot of burden between the first and second lifts; namely, assuring that the maximum time from the first detonation to the last for forming an in situ oil shale retort is not so long that control of the sequence of detonations is degraded.

The time delay between the second and third lifts is preferably at least about 10 milliseconds per foot of burden. A longer time delay between the second and third lifts, as compared with the time delay between the first and second lifts, is preferred so that there is sufficient time for formation in the second lift to move completely out of the way before formation from the third lift commences expanding. It is believed that the second lift does not move out of the way as rapidly as the first lift since some interference of fragments from the first and second lifts can occur and the available void for explosive expansion of the second lift is less than the available void for explosive expansion of the first lift. For these reasons, more time is needed to assure that expanding formation in the second lift does not interfere with initial explosive expansion of formation from the third lift.

For similar reasons, such as the progressively decreasing available void volume, as preceding lifts fill available void spaces and slower expansion of the third lift due to interference from the second lift, it is preferred that the time delay between the third and fourth lifts be at least 15 milliseconds per foot of burden. This assures that expanding formation from the third lift does not interfere with initial explosive expansion of formation from the fourth lift, resulting in abnormally low void fraction in formation adjacent the upper portion of the fragmented mass in the retort. Further, a time delay of at least about 15 milliseconds per foot of burden is desirable before detonation of the uppermost lift to minimize dissipation of explosive energy from the uppermost lift into formation overlying the in situ oil shale retort. This tends to minimize overbreakage into overlying formation and sloughing of such formation over the fragmented mass in the retort.

When more than two lifts are explosively expanded, it is particularly preferred to have time delays between lifts near the minima stated. That is, the time delay between the first and second lifts is preferably about five milliseconds per foot of burden and the time delay between the second and third lifts is preferably about ten milliseconds per foot of burden. If there is a fourth lift, it is particularly preferred that the time delay between the third and fourth lifts be about fifteen milliseconds per foot of burden.

There are a number of reasons these shorter delay times are desirable in addition to easing problems of maintaining precision of timing when long sequences are used. Short time delays minimize chances of slabs falling from the unfragmented formation of a lift overlying a lift being expanded. If there is any interaction between successive lifts for minimizing over-expansion of early lifts, the shorter delays better enable such interaction while avoiding premature interaction. Short time delays minimize the chance of damaging explosive charges in a subsequent lift due to detonation of explosive charges in a preceding lift.

Although specifically described with respect to only two embodiments of the technique for forming an in situ oil shale retort, many modifications and variations will be apparent to one skilled in the art. Thus, the retort can have any of a broad variety of heights, horizontal cross-sections, patterns of distribution of explosive charges, and the like. A variety of techniques can be employed for processing the fragmented mass formed in the retort by this technique. Many other modifications and variations will be apparent to one skilled in the art and it is, therefore, to be understood that within the scope of the appended claims, the invention may be practiced otherwise than as specifically described.

What is claimed is:

1. A method for forming an in situ oil shale retort at a retort site in a subterranean formation containing oil shale, the retort having top, bottom, and side boundaries of unfragmented formation and containing a fragmented permeable mass of formation particles, comprising the steps of:

excavating a void adjacent the bottom boundary of the retort site leaving an overlying zone of unfragmented formation within the side boundaries of the retort site;

placing a first plurality of generally vertical columnar explosive charges in a first horizontally extending array in a first lift of the zone of unfragmented formation above the void;

placing a second plurality of generally vertical columnar explosive charges in a second horizontally extending array in a second lift of the zone of unfragmented formation above the first lift;

detonating the first plurality of explosive charges for explosively expanding the first lift toward the void and forming a first portion of a fragmented permeable mass of formation particles in the retort; and after a time delay of at least about five milliseconds per foot of burden distance of the second plurality of explosive charges, detonating the second plurality of explosive charges in a single round with the first plurality of explosive charges for explosively expanding the second lift toward the void for forming a second portion of the fragmented mass in the retort, the delay interval between explosive charges within the second array being up to about two milliseconds per foot of spacing distance between such explosive charges.

2. A method as recited in claim 1 wherein the time delay is less than about 30 milliseconds per foot of burden distance of the second plurality of explosive charges.

3. A method as recited in claim 1 wherein the volume of the void is a limited void relative to the volume of the first lift explosively expanded towards the void.

4. A method as recited in claim 1 wherein each lift is explosively expanded toward an available void having a volume up to about 55% of the volume of the available void plus the volume of formation explosively expanded toward that available void.

5. A method for forming an in situ oil shale retort at a retort site in a subterranean formation containing oil shale, the retort having top, bottom, and side boundaries of unfragmented formation, comprising the steps of:

excavating a void adjacent the bottom boundary of the retort site leaving an overlying zone of unfragmented formation within the side boundaries of the retort site and having a horizontally extending free face over the void;

detonating a plurality of explosive charges in a horizontally extending array in the zone of unfragmented formation for explosively expanding a first lift from the zone of unfragmented formation toward the void and creating a new generally horizontally extending free face above the first lift; and after a time delay detonating a second plurality of explosive charges in a single round in a horizontally extending array of generally vertically extending columnar explosive charges above the first plurality of explosive charges for explosively expanding a second lift of formation from the zone of unfragmented formation toward the void, the delay interval between explosive charges within the second array being up to about two milliseconds per foot of spacing distance between such explosive charges, the time delay before detonating the second plurality of explosive charges being in the range of from about five to fifteen milliseconds per foot of burden distance from the second plurality of explosive charges to the newly created free face.

6. A method as recited in claim 5 wherein the volume of the void is a limited void relative to the volume of the first lift explosively expanded towards the void.

7. A method as recited in claim 5 wherein each lift is explosively expanded towards an available void volume that is a limited void.

8. A method for forming an in situ oil shale retort in a retort site in a subterranean formation containing oil shale, the retort having top, bottom, and side boundaries of unfragmented formation and containing a fragmented permeanble mass of formation particles comprising the steps of:

excavating a void adjacent the bottom boundary of the retort site leaving an overlying zone of unfragmented formation within the side boundaries of the retort site and having a horizontally extending free face over the void;

detonating a plurality of explosive charges in a first lift in the zone immediately above the void for explosively expanding the first lift downwardly toward the void;

detonating a plurality of vertically extending columnar explosive charges in a second lift in the zone immediately above the first lift with a first time delay of at least about five and less than about fifteen milliseconds per foot of burden distance of the explosive charges in the second lift after detonation of the explosive charges in the first lift for explosively expanding the second lift downwrdly toward the void, the delay interval between explosive charges within the second lift being up to about two miliseconds per foot of spacing distance between such explosive charges; and detonating a plurality of explosive charges in a third lift in the zone immediately above the second lift with a second time delay greater than the first time delay and in the range of about ten to twenty milliseconds per foot of burden distance of the explosive charges in the third lift after detonation of explosive charges in the second lift for explosively expanding the third lift downwardly toward the void, the delay interval between explosive charges within the third lift being up to about two milliseconds per foot of spacing distance between such explosive charges.

9. A method as recited in claim 8 wherein the underlying void is a limited void relative to the volume of formation in the first lift explosively expanded toward the void.

10. A method as recited in claim 8 further comprising detonating a plurality of explosive charges in a fourth lift in the zone immediately above the third lift with a third time delay of at least about 15 milliseconds per foot of burden distance of the explosive charges in the fourth lift after detonation of explosive charges in the third lift for explosively expanding the fourth lift toward the void.

11. A method as recited in claim 10 wherein each lift is explosively expanded toward an available void having a volume up to about 55% of the volume of the available void plus the volume of formation explosively expanded toward that available void.

12. A method as recited in claim 10 wherein the third time delay is in the range of from about 15 to 30 milliseconds per foot of burden distance of explosive charges in the fourth lift.

13. A method as recited in claim 8 wherein each time delay is less than about 30 milliseconds per foot of burden distance.

14. A method as recited in claim 8 wherein each lift is explosively expanded toward an available void having a volume up to about 55% of the volume of the available void plus the volume of formation explosively expanded toward that available void.

15. A method for forming an in situ oil shale retort in a retort site in a subterranean formation containing oil shale, the retort having top, bottom, and side boundaries of unfragmented formation and containing a fragmented permeable mass of formation particles comprising the steps of:

excavating a void adjacent the bottom boundary of the retort site leaving an overlying zone of unfragmented formation within the side boundaries of the retort site having a generally horizontally free face over the void; and explosively expanding the overlying zone of formation toward the underlying void in a plurality of lifts in a single round for forming a fragmented permeable mass of formation particles in the retort, wherein the volume of the void relative to the volume of formation explosively expanded is a limited void by the steps of:

detonating a plurality of explosive charges in a first lift in the zone immediately above the void for explosively expanding the first lift downwardly toward the void;

detonating a plurality of explosive charges in a second lift in the zone immediately above the first lift with a time delay in the range of from about five to fifteen milliseconds per foot of burden distance of explosive charges in the second lift after detonation of explosive charges in the first lift for explosively expanding the second lift downwardly toward the void, the delay interval between explosive charges within the second lift being up to about two milliseconds per foot of spacing distance between such explosive charges;

detonating a plurality of explosive charges in a third lift in the zone immediately above the second lift with a time delay after detonation of explosive charges in the second lift in the range of from about 10 to 20 milliseconds per foot of burden distance of the explosive charges in the third lift for explosively expanding the third lift downwardly toward the void, the delay interval between explosive charges within the third lift being up to about two milliseconds per foot of spacing distance between such explosive charges; and detonating a plurality of explosive charges in a fourth lift in the zone immediately above the third lift with a time delay after detonation of explosive charges in the third lift in the range of from about 15 to 30 milliseconds per foot of burden distance of explosive charges in the fourth lift for explosively expanding the fourth lift downwardly toward the void, the delay interval between explosive charges within the fourth lift being up to about two milliseconds per foot of spacing distance between such explosive charges.

16. A method as recited in claim 15 wherein each of the explosive charges comprises a generally vertically extending columnar explosive charge.

17. A mehtod as recited in claim 15 wherein each lift is explosively expanded toward an available void having a volume up to about 55% of the volume of the available void plus the volume of formation explosively expanded toward that available void.

18. A method for forming an in situ oil shale retort in a retort site in a subterranean formation containing oil shale, the retort having top, bottom, and side boundaries of unfragmented formation and containing a fragmented permeable mass of formation particles comprising the steps of:

excavating a lower level void adjacent the bottom boundary of the retort site;

excavating an upper level void adjacent the upper boundary of the retort site leaving an intervening zone of unfragmented formation within the side boundaries of the retort site between the upper level and lower level voids;

placing a first plurality of generally vertically extending columnar explosive charges in a first horizontally extending array in a first lift of the zone of unfragmented formation immediately above the lower level void;

placing a second plurality of generally vertically extending columnar explosive charges in a second horizontally extending array in a remaining portion of the zone of unfragmented formation above the first lift;

detonating the first plurality of explosive charges for explosively expanding the first lift toward the lower level void; and detonating the second plurality of explosive charges with a time delay in the range of from about five to fifteen milliseconds per foot of burden distance of the second plurality of explosive charges after detonation of the first plurality of explosive charges for explosively expanding the remaining portion of the zone of unfragmented formation downwardly toward the lower level void and upwardly toward the upper level void, the delay interval between explosive charges within the second array being up to about two milliseconds per foot of spacing distance between such explosive charges.

19. A method as recited in claim 18 wherein the lower level void is a limited void relative to the volume of formation explosively expanded toward the lower level void.

20. A method for forming an in situ oil shale retort in a retort site in a subterranean formation containing oil shale, the retort having top, bottom and side boundaries of unfragmented formation and containing a fragmented permeable mass of formation particles, comprising the steps of:

excavating a void adjacent the bottom boundary of the retort site leaving an overlying zone of unfragmented formation within the side boundaries of the retort site; and explosively expanding the overlying zone of formation toward the underlying void in a plurality of lifts in a single round wherein the underlying void is a limited void relative to the volume of formation explosively expanded towards the underlying void including the steps of:

detonating a first plurality of explosive charges in a first lift immediately above the void for explosively expanding the first lift downwardly toward the void;

detonating a second plurality of explosive charges in a second lift in the zone immediately above the first lift for explosively expanding the second lift downwardly toward the void, the delay interval between detonations of explosive charges in the second lift being up to about two milliseconds per foot of spacing distance between such explosive charges; and detonating a third plurality of explosive charges in a third lift in the zone immediately above the second lift for explosively expanding the third lift downwardly toward the void, the delay interval between detonations of explosive charges in the second lift being up to about two milliseconds per foot of spacing distance between such explosive charges; and wherein the time delay between detonation of the second plurality of explosive charges and detonation of the third plurality of explosive charges is greater than the time delay between detonation of the first plurality of explosive charges and detonation of the second plurality of explosive charges, said time delay being measured in units of time per unit of burden distance of such explosive charges, and wherein each time delay is in the range of from about five to thirty milliseconds per foot of burden distance.

21. A method as recited in claim 20 wherein each of said explosive charges comprises a generally vertically extending columnar explosive charge.

22. A method as recited in claim 20 wherein each lift is explosively expanded toward an available void having a volume up to about 55% of the volume of the available void plus the volume of formation explosively expanded toward that available void.

23. A method for forming an in situ oil shale retort in a retort site in a subterranean formation containig oil shale, the retort having top, bottom and side boundaries of unfragmented formation and containing a fragmented permeable mass of formation particles, comprising the steps of:

excavating a void adjacent the bottom boundary of the retort site leavig an overlying zone of unfragmented formation within the side boundarise of the retort site; and explosively expanding the overlying zone of formation toward the underlying void in a plurality of lifts in a single round wherein the underlying void is a limited void relative to the volume of formation explosively expanded toward the underlying void including the steps of:

detonating a first plurality of generally vertically extending columnar explosive charges in a first lift immediately above the void for explosively expanding the first lift downwardly toward the void;

detonating a second plurality of generally vertically extending columnar explosive charges in a second lift in the zone immediately above the first lift for explosively expanding the second lift downwrdly toward the void; and detonating a third plurality of generally vertically extending columnar explosive charges in a third lift in the zone immediately above the second lift for explosively expanding the third lift downwardly toward the void; and wherein the time delays between detonation of explosive charges between successive lifts progressively increase from the bottom up, said time delays being measured in units of time per unit of burden distance of such explosive charges, and wherein each time delay is at least about five milliseconds per foot of burden distance of such explosive charges, and wherein the delay interval between explosive charges within each lift is up to about two milliseconds per foot of spacing distance between such explosive charges.

24. A method as recited in claim 23 wherein each time delay is less than about thrity milliseconds per foot of burden distance of such explosive charges.

25. A method as recited in claim 23 wherein each lift is explosively expanded toward an available void having a volume up to about 55% of the volume of the available void plus the volume of formation explosively expanded toward that available void.

* * * * *